US006652112B1

(12) United States Patent
Lucarelli

(10) Patent No.: US 6,652,112 B1
(45) Date of Patent: Nov. 25, 2003

(54) DECORATIVE LIGHT STRIP FOR SELF-ATTACHING TO A RAIN GUTTER OR A ROOF OVERHANG

(76) Inventor: Michael J. Lucarelli, 2 W. Dosoris La., Dix Hills, NY (US) 11746

( * ) Notice: Subject to any disclaimer, the term of this patent is extended or adjusted under 35 U.S.C. 154(b) by 0 days.

(21) Appl. No.: 10/135,320

(22) Filed: Apr. 29, 2002

(51) Int. Cl.[7] ..... F21S 8/00; F21V 21/088
(52) U.S. Cl. ..... 362/145; 362/249; 362/396
(58) Field of Search ..... 362/145, 147, 362/227, 249, 250, 252, 151, 152, 396

(56) References Cited

U.S. PATENT DOCUMENTS 3,404,268 A * 10/1968 Fowler ..... 362/250
3,714,409 A * 1/1973 Trudeau ..... 362/252
3,883,926 A * 5/1975 Reynolds ..... 362/249
4,357,653 A 11/1982 Kovacs
4,819,135 A * 4/1989 Padilla et al. ..... 362/252
4,852,832 A 8/1989 Delaney
5,067,061 A 11/1991 Prickett
5,113,329 A * 5/1992 Lin ..... 362/249
5,441,224 A 8/1995 Ludwig
5,469,344 A 11/1995 Kotsakis
5,581,956 A * 12/1996 Fennessy et al. ..... 362/145
6,076,938 A * 6/2000 Kinderman ..... 362/249
6,186,644 B1 2/2001 Mosseau
6,217,192 B1 4/2001 Stratton
6,302,560 B1 * 10/2001 Lai ..... 362/249
6,363,662 B1 * 4/2002 Coates ..... 362/147

* cited by examiner

*Primary Examiner*—Alan Cariaso
(74) *Attorney, Agent, or Firm*—Richard L. Miller

(57) ABSTRACT

A decorative light strip that self-attaches to a rain gutter or a roof overhang and which includes a body that is self-attached to the rain gutter or the roof overhang, at least one incandescent lamp socket operatively connected to the body, and an electrical line cord electrically communicating the at least one incandescent lamp socket with a power source. The body is a foam tube that is flexible, compressible, slender, and elongated, and has a split extending longitudinally along the length thereof and which receivingly engages, so as to self-attach the foam tube of the body to, the rain gutter or the roof overhang. The at least one incandescent lamp socket extends laterally in the foam tube of the body. The electrical line cord extends longitudinally in the foam tube of the body. The foam tube of the body is either continuous or discontinuous.

3 Claims, 1 Drawing Sheet

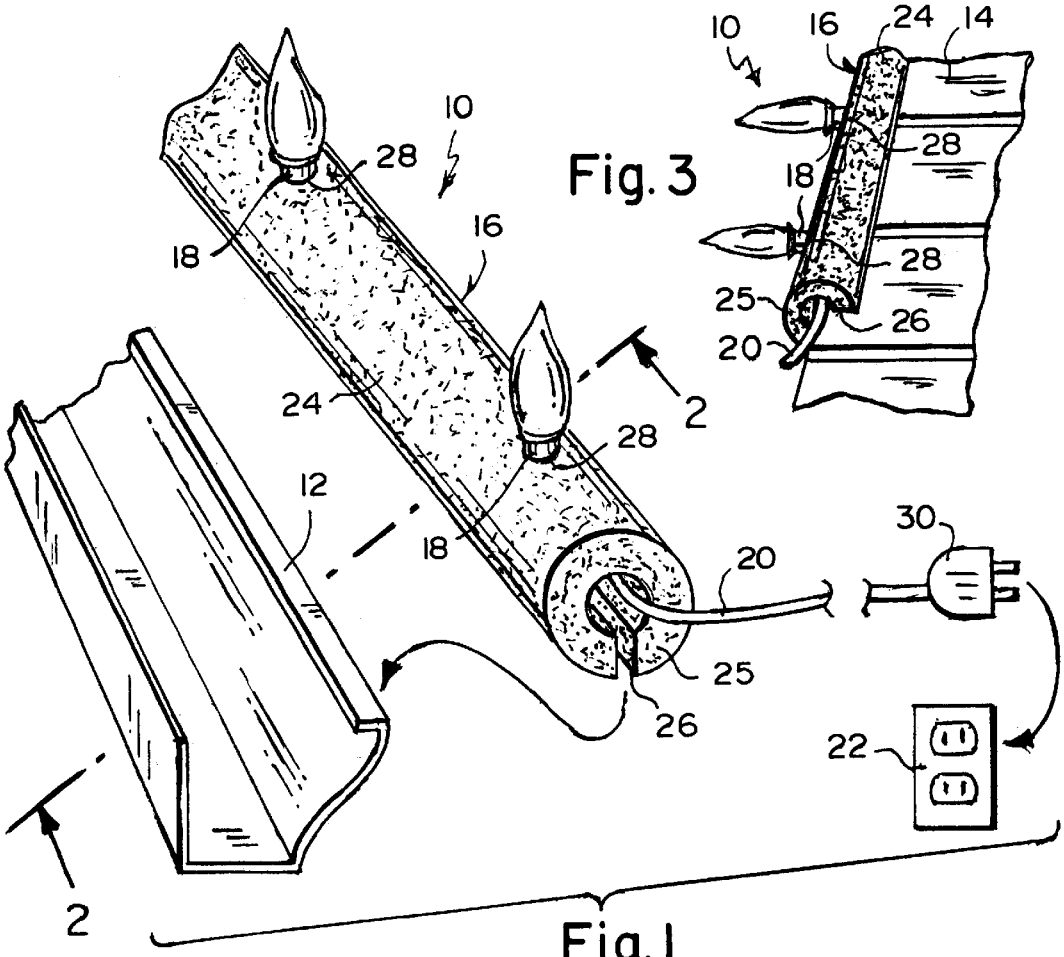
Fig. 1
Fig. 3
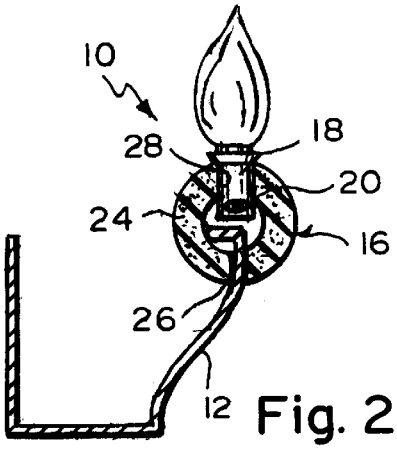
Fig. 2
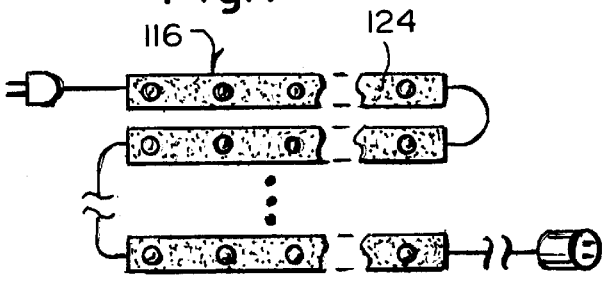
Fig. 4

DECORATIVE LIGHT STRIP FOR SELF-ATTACHING TO A RAIN GUTTER OR A ROOF OVERHANG

BACKGROUND OF THE INVENTION

1. Field of the Invention

The present invention relates to a decorative light strip. More particularly, the present invention relates to a decorative light strip for self-attaching to a rain gutter or a roof overhang.

2. Description of the Prior Art

Numerous innovations for light strips have been provided in the prior art that will be described. Even though these innovations may be suitable for the specific individual purposes to which they address, however, they differ from the present invention.

A first example, U.S. Pat. No. 4,357,653 to Kovacs teaches an adjustable four sided frame assembled of four easily cut-to-length channeled members for displaying strands of Christmas light bulbs around rectangular window panes and having notched flanges running along opposite side of such member for the length of the same for engaging tinsel foil wrapping and each member having slotted apertures in a longitudinal inner side flange for holding the light bulbs. The frame knocks down for storage.

A second example, U.S. Pat. No. 4,852,832 to Delaney teaches a decorative light holder which includes means for retaining separate lights and intermediate wiring along straight and curvilinear paths including paths perpendicular to each other; and includes contact adhesive means to permit easy attachment on walls or other structures, such as window frames or adjacent interior or exterior wall structures.

A third example, U.S. Pat. No. 5,067,061 to Prickett teaches a decorative trim lighting system that includes an elongated, resilient retaining strip which is formed in a laterally folded configuration and is securable to an exterior surface portion of a building. The bulb socket portions of a decorative light string are removably received in a longitudinally spaced series of openings formed through the strip, and a longitudinally spaced series of bent edge portions of the strip overlie and releasably hold the longitudinal electrical power supply wiring segments interconnecting the sockets. The strip may also be used to slidably and releasably hold enlarged end portions of retaining tab members to which the sockets are secured.

A fourth example, U.S. Pat. No. 5,441,224 to Ludwig teaches a retainer for attaching wiring, such as a continuous strand of decorative Christmas lights, to objects such as facia, rain gutters, eaves, walls, ceilings, and windows is disclosed. The retainer has a receiving means for accepting and holding the wiring. The retainer can be attached to the object by the use of an adhesive, by the use of a fastener, or a combination of the two.

A fifth example, U.S. Pat. No. 5,469,344 to Kotsakis teaches an elongate member defining spaced apart openings each for inserted reception of a decorative light bulb of a light string. Flanges provided on the interior of each of the openings frictionally engage the light bulb surface and restrain same against accidental separation from the opening. Apertures in the elongate member each serve to receive a fastener, such as a finishing nail, attaching the elongate member to a wall surface. The elongate members are of a convenient length to permit orderly bundling of those elongate members associated with a single light string to provide for orderly removal, storage and installation of the light string.

A sixth example, U.S. Pat. No. 6,188,644 B1 to Kotsakis teaches a decorative lighting system that is used with a string of lights, usually of the "mini-light" type. A string of lights is mounted in an extruded plastic channel, with the light sockets engaged in respective apertures spaced along one side of the channel. A cap snap fits over the open side of the channel to form a complete box section housing all the wiring and inner ends of the light sockets. The resulting unit is mounted on a window using an appropriate fastener, preferably hook and loop fastener, along the channel base and the window pane.

A seventh example, U.S. Pat. No. 6,217,192 B1 to Stratton teaches a decorative trim light supporting apparatus that is formed by an elongated resilient strip having a series of longitudinally spaced apertures therethrough. Strip fasteners projecting through elected apertures removably anchor the strip to a surface. Friction gripping bulb socket supports are removably received by other apertures.

It is apparent that numerous innovations for light strips have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a decorative light strip for self-attaching to a rain gutter or a roof overhang that avoids the disadvantages of the prior art.

Another object of the present invention is to provide a decorative light strip for self-attaching to a rain gutter or a roof overhang that is simple and inexpensive to manufacture.

Still another object of the present invention is to provide a decorative light strip for self-attaching to a rain gutter or a roof overhang that is simple to use.

Briefly stated, still yet another object of the present invention is to provide a decorative light strip that self-attaches to a rain gutter or a roof overhang and which includes a body that is self-attached to the rain gutter or the roof overhang, at least one incandescent lamp socket operatively connected to the body, and an electrical line cord electrically communicating the at least one incandescent lamp socket with a power source. The body is a foam tube that is flexible, compressible, slender, and elongated, and has a split extending longitudinally along the length thereof and which receivingly engages, so as to self-attach the foam tube of the body to, the rain gutter or the roof overhang. The at least one incandescent lamp socket extends laterally in the foam tube of the body. The electrical line cord extends longitudinally in the foam tube of the body. The foam tube of the body is either continuous or discontinuous.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of a first embodiment of the present invention being attached to a rain gutter;

FIG. 2 is a diagrammatic cross sectional view taken along line 2—2 of FIG. 1;

FIG. 3 is a diagrammatic perspective view of the present invention attached to a roof overhang; and FIG. 4 is a diagrammatic top plan view of a second embodiment of the present invention.

LIST OF REFERENCE NUMERALS UTILIZED IN THE DRAWING

10 decorative light strip of present invention 10 for self-attaching to rain gutter 12 or roof overhang 14
12 rain gutter
14 roof overhang
16 body for self-attaching to rain gutter 12 or roof overhang 14
18 at least one incandescent lamp socket
20 electrical line cord for electrically communicating at least one incandescent lamp socket 18 with power source 22
22 power source
24 foam tube of body 16
25 end of foam tube 24 of body 16
26 split extending longitudinally along length of foam tube 24 of body 16 for receivingly engaging, so as to self-attach foam tube 24 of body 16 to, rain gutter 12 or roof overhang 14
28 at least one bore extending laterally in foam tube 24 of body 16
30 plug of electrical line cord 20 for electrically engaging power source 22

SECOND EMBODIMENT

116 body
124 foam tube 124 of body 116

DETAILED DESCRIPTION OF THE PREFERRED EMBODIMENT

Referring now to the figures, in which like numerals indicate like parts, and particularly to FIGS. 1–3, the decorative light strip of the present invention is shown generally at 10 for self-attaching to a rain gutter 12 (FIGS. 1 and 2) or a roof overhang 14 (FIG. 3).

The configuration of the decorative light strip 10 can best be seen in FIGS. 1–3, and as such, will be discussed with reference thereto.

The decorative light strip 10 comprises a body 16 for self-attaching to the rain gutter 12 (FIGS. 1 and 2) or the roof overhang 14 (FIG. 3), at least one incandescent lamp socket 18 that is operatively connected to the body 16, and an electrical line cord 20 for electrically communicating the at least one incandescent lamp socket 18 with a power source 22.

The body 16 is a foam tube 24 that is flexible, compressible, slender, and elongated.

The foam tube 24 of the body 16 has an end 25, a length, and a split 26 that extends longitudinally along the length thereof and is for receivingly engaging, so as to self-attached the foam tube 24 of the body 16 to, the rain gutter 12 (FIGS. 1 and 2) or the roof overhang 14 (FIG. 3).

The foam tube 24 of the body 16 further has at least one bore 28 that extends laterally therein and is disposed opposite to the split 26 therein.

The at least one incandescent lamp socket 18 extends in the at least one bore 28 in the foam tube 24 of the body 16, and is maintained therein, by the compressibility of the foam tube 24 of the body 16.

The electrical line cord 20 extends longitudinally in the foam tube 24 of the body 16, and out the end 25 of the foam tube 24 of the body 16 to terminate in a plug 30 for electrically engaging the power source 22.

The foam tube 24 of the body 16 is continuous.

A second embodiment of the foam tube 124 of the body 116 can best be seen in FIG. 4, and as such, will be discussed with reference thereto.

The foam tube 124 of the body 116 is discontinuous.

It will be understood that each of the elements described above, or two or more together, may also find a useful application in other types of constructions differing from the types described above.

While the invention has been illustrated and described as embodied in a decorative light strip for self-attaching to a rain gutter or an overhang of a roof, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A decorative light strip for self-attaching to a rain gutter or a roof overhang, comprising:

a) a body;

b) at least one incandescent lamp socket; and c) an electrical line cord;

wherein said body is for self-attaching to the rain gutter or the roof overhang;

wherein said at least one incandescent lamp socket is operatively connected to said body;

wherein said electrical line cord is for electrically communicating said at least one incandescent lamp socket with a power source;

wherein said body is a foam tube;

wherein said foam tube of said body is flexible;

wherein said foam tube of said body is compressible;

wherein said foam tube of said body is slender;

wherein said foam tube of said body is elongated;

wherein said foam tube of said body has an end;

wherein said foam tube of said body has a length;

wherein said foam tube of said body has a split;

wherein said split that extends longitudinally along said length of said foam tube of said body;

wherein said split is for receivingly engaging, so as to self-attach said foam tube of said body to, the rain gutter or the roof overhang;

wherein said foam tube of said body has at least one bore;

wherein said at least one bore extends laterally in said foam tube of said body;

wherein said at least one bore is disposed opposite to said split in said foam tube of said body;

wherein said at least one incandescent lamp socket extends in said at least one bore in said foam tube of said body, and is maintained therein, by said compressibility of said foam tube of said body;

wherein said electrical line cord extends longitudinally in said foam tube of said body;

wherein said electrical line cord extends out said end of said foam tube of said body;

wherein said electrical line cord terminates in a plug; and wherein said plug of said electrical line cord is for electrically engaging the power source.

2. The strip as defined in claim 1, wherein said foam tube of said body is continuous.

3. The strip as defined in claim 1, wherein said foam tube of said body is discontinuous.

* * * * *